United States Patent [19]

Patsiokas

[11] Patent Number: 4,591,863

[45] Date of Patent: May 27, 1986

[54] LOW PROFILE ANTENNA SUITABLE FOR USE WITH TWO-WAY PORTABLE TRANSCEIVERS

[75] Inventor: Stelios J. Patsiokas, Hollywood, Fla.

[73] Assignee: Motorola, Inc., Schaumburg, Ill.

[21] Appl. No.: 596,862

[22] Filed: Apr. 4, 1984

[51] Int. Cl.[4] ..... H01Q 1/48

[52] U.S. Cl. ..... 343/702; 343/830; 343/834

[58] Field of Search ..... 343/845, 846, 702, 829, 343/830, 833, 834

[56] References Cited

U.S. PATENT DOCUMENTS

| | | | |
|---|---|---|---|
| 3,184,746 | 5/1965 | Chatelain | 343/742 |
| 3,573,628 | 4/1971 | Cramer, Jr. et al. | 343/702 |
| 3,623,161 | 11/1971 | Fujimoto et al. | 343/702 |
| 4,021,810 | 5/1977 | Urpo et al. | 343/846 |
| 4,123,756 | 10/1978 | Nagata et al. | 343/702 |
| 4,313,119 | 1/1982 | Garay et al. | 343/702 |

OTHER PUBLICATIONS

Frink, Jr. Abstract No. 656,243, Antenna, published Dec. 20, 1949, 3700.6.757.

*Primary Examiner*—Eli Lieberman

*Attorney, Agent, or Firm*—Mark P. Kahler; Joseph T. Downey; Edward M. Roney

[57] ABSTRACT

A low profile antenna structure includes a substantially planar conductive sheet having a substantially planar conductive member extending from one end at a normal angle. A driven radiating element and a parasitic radiating element are disposed adjacent the conductive sheet. A feed point is coupled to the driven element for coupling RF energy to and from the antenna. Both the driven and the parasitic elements are approximately one quarter wavelength long and are approximately parallel to one another and are situated approximately 1/20th of a wavelength apart.

6 Claims, 6 Drawing Figures

LOW PROFILE ANTENNA SUITABLE FOR USE WITH TWO-WAY PORTABLE TRANSCEIVERS

BACKGROUND OF THE INVENTION

1. Field of the Invention

This invention relates generally to the field of antenna structures for two-way portable transceivers. More particularly, this invention relates to low profile antenna structures suitable for packaging within the battery enclosure of a portable two-way transceiver or otherwise enclosed within the transceiver housing.

2. Background

A conventional portable two-way transceiver is depicted generally as transceiver 10 in FIG. 1.

An exemplary transceiver is the 800 Mhz MX-300 series of radios manufactured by Motorola, Inc., the Assignee of the present invention. Such transceivers normally include an external antenna 12 attached to the uppermost portion of transceiver 10. The electronic circuitry which makes up the transmitter and receiver (ie. the transceiver itself) are normally housed primarily in a housing 14. A battery pack 16 typically attaches to the bottom portion of housing 14. This battery pack normally encloses one or more electrical battery cells along with associated components and circuitry necessary to effect and control charging of the battery cells.

Transceiver 10 is shown to have an overall height of L1 made up of the height of the antenna shown as L2, the height of the housing shown as L3 and the height of the battery pack shown as L4. For a typical model of the MX-300 series transceiver, the overall height L1 is approximately 15.4 inches, L2 is approximately 7.7 inches, L3 is approximately 4.1 inches, and L4 is approximately 3.6 inches.

The present invention allows for elimination of the conventional top-mounted antenna 12 and provides for a highly efficient radiating structure which may be placed within the battery pack or receiver housing. One resulting configuration is shown in FIG. 2 generally as transceiver 20. By utilizing the present invention within the battery pack, the overall height may be significantly reduced. The resulting transceiver 20 has an overall height shown as L5 made up of the height of transceiver housing 14 which remains unchanged and the slightly increased height of the battery pack/antenna 22 shown as L6. In one embodiment of the present invention, height L6 is only 4.6 inches resulting in an overall height L5 of 8.7 inches without sacrifice of battery capacity. This is an overall reduction in height of 6.7 inches. Of course, further height reductions are possible if battery life is not a prime consideration. This height reduction is possible without unacceptable compromise of antenna performance. Similar height reductions are possible with the antenna structure integrated within the transceiver housing rather than the battery enclosure.

While the specific antenna configuration disclosed herein may be utilized in locations other than a battery enclosure a number of important advantages are attained by placing the antenna in the battery enclosure. The electrical battery cells help to provide an excellent counterpoise for operation of the antenna structure and helps shield radiation from sensitive radio components. In addition, the antenna is well protected and less likely to be damaged when enclosed within the battery pack. Also, by removing the antenna from the upper surface of transceiver housing 14, more vital space for transceiver controls is free. This aspect is becoming increasingly important as the level of complexity of two-way portable transceivers is rapidly increasing.

SUMMARY OF THE INVENTION

It is an object of the present invention to provide an improved antenna structure.

It is another object of the present invention to provide an improved low profile antenna structure suitable for use inside the battery pack of a two-way portable transceiver.

It is another object of the present invention to provide a vertically polarized high efficiency antenna structure suitable for replacing conventional sleeve dipole antennas in portable two-way transceivers.

It is yet another object of the present invention to provide an improved antenna arrangement for reducing the overall height of portable two-way transceivers.

These and other objects of the present invention will become apparent to those skilled in the art upon consideration of the following description of the invention.

In one embodiment of the present invention a low profile antenna structure suitable for use with two way portable transceivers over a wide range of frequencies about a center frequency includes a substantially planar conductive sheet having first and second opposed major surfaces and a terminating boundary has a counterpoise disposed adjacent the first major surface extending from the first major surface at a normal angle. A driven radiating element is situated adjacent the first major surface and has a driven and a free end with a total length of approximately one quarter wavelength. A feed point is coupled to the first end for coupling RF energy to and from the driven element. A parasitic element has first and second ends and is also approximately one quarter of a wavelength in total length. The parasitic element is situated substantially parallel to the driven element adjacent the conductive sheet and is operatively situated adjacent the driven element so that the first and driven ends and the second and free ends respectively are closest together. The elements are separated by approximately 1/20th of a wavelength.

The features of the invention believed to be novel are set fourth with particularity in the appended claims. The invention itself, however, both as to organization and method of operation, together with further objects and advantages thereof, may be best understood by reference to the following description taken in conjunction with the accompanying drawings.

DESCRIPTION OF THE PREFERRED EMBODIMENT

Figure 1:
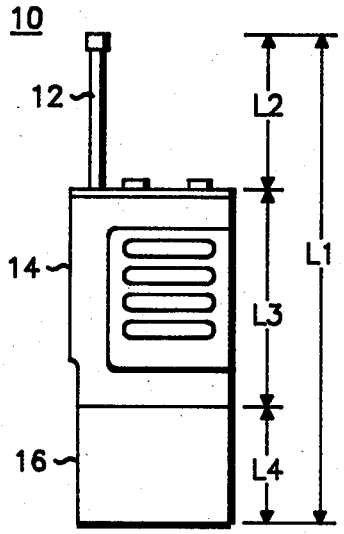
PRIOR ART Fig. 1
FIG. 1 shows a conventional two-way portable transceiver having a top mounted antenna structure.
Figure 2:
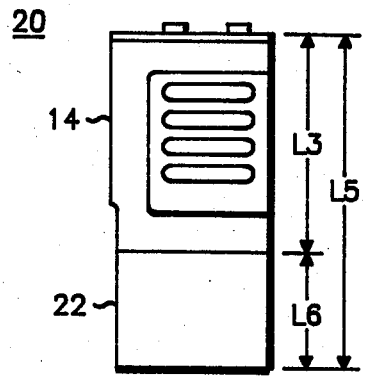
FIG. 2 shows a two-way portable transceiver incorporating the present invention.
Figure 3:
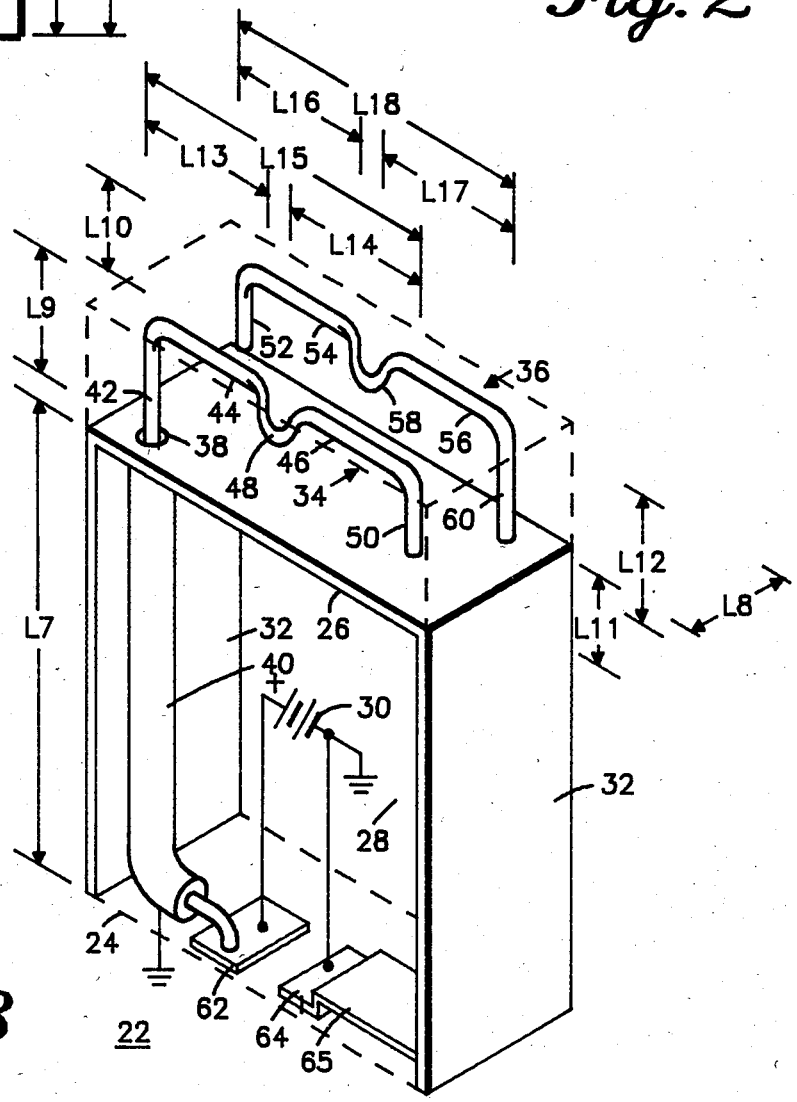
FIG. 3 shows a detailed drawing of the antenna structure of the present invention incorporated within a battery pack.

Turning now to FIG. 3, the vertically polarized, low profile antenna structure of the preferred embodiment of the present invention is shown and generally referred to as battery pack/antenna 22. This embodiment is shown to be enclosed within a battery enclosure 24 shown in broken lines for clarity. Battery pack/antenna 22 is also shown inverted relative to its position in FIG. 2 to enhance clarity. Due to the antenna's vertical polarization, it may be utilized either as shown in FIG. 2 or inverted similar to FIG. 3 with equivalent performance. For convenience of description, FIG. 3 will hereinafter be considered to be upright even though it is upside down as used in the preferred embodiment in conjunction with a battery pack.

A substantially planar rectangular conductive sheet 26 is disposed horizontally within enclosure 24 and separates the main antenna structure from a battery compartment 28. Conductive sheet 26 serves as a portion of the antenna's counterpoise the remainder of which will be discussed later. Battery compartment 28 is used to contain one or more electrical battery cells 30 shown schematically in FIG. 3. One skilled in the art will recognize that most antenna structures perform best when disposed above (or below) an extensive ground plane. This has created severe problems in the design of prior art antenna structures for use in portable two-way transceivers since an extensive ground plane is virtually impossible to create in a small hand held transceiver. The present invention, however, partially overcomes this difficulty by utilizing the electrical battery cells as a portion of the antenna's counterpoise. This is about the best ground plane possible in a two-way portable transceiver environment.

Alternately, this antenna arrangement may be disposed within the transceiver housing in which case the counterpoise may require slight modification to account for the absence of the battery cells and substitution of the transceiver circuitry therefor. By metalizing the housing or similar techniques the counterpoise may be made suitable.

The preferred counterpoise arrangement includes a vertical conductive member 32 attached to each end of conductive sheet 26 and extending downward at approximately a normal angle. The length of conductive member 32 is labled L7 in FIG. 3. This length is not critical but if L7 is set at approximately one quarter wavelength the antenna performance is enhanced. While the preferred embodiment shows a conductive member 32 at each end of conductive sheet 26 this is not to be limiting as one or more such conductive members possibly in conjunction with metalizing portions of the enclosure may be effectively utilized in the present antenna configuration as long as a good counterpoise is provided.

In the present embodiment, conductive members 32 are made of thin copper sheets or shim stock. In other embodiments it may be desirable to provide metalization of the battery enclosure or other enclosure to provide an operative counterpoise. Such variations may alter the antenna impedance, bandwidth or other characteristics. Careful testing of such variations should be undertaken to ensure satisfactory performance. In any case, a suitable counterpoise should be provided for the present antenna configuration to ensure proper performance.

The main antenna structure is disposed above conductive sheet 26 and is made up of a driven radiating element 34 and a parasitic radiating element 36 both of which may be made of 15 gauge wire or the like. Driven element 34 is driven at a feed point 38 which may be coupled directly to a 50 ohm transmission line 40. Transmission line 40 is a coaxial transmission line in the preferred embodiment but stripline, twinlead, etc. may also be suitable in many situations. Also, in the preferred embodiment standard 50 ohm transmission line is preferred but other situations may dictate a different characteristic impedance.

Driven radiating element 34 is made up of a first vertical portion 42 attached at a right angle to a first horizontal portion 44. A second horizontal portion 46 is attached to the first horizontal portion 44 with with a U-shaped bent portion 48 in between. Horizontal portion 46 is attached to a second vertical portion 50 which is not attached to conductive sheet 26.

The parasitic radiating element 36 is shaped similarly to the driven element 34. It is made up of a third vertical portion 52 attached to a third horizontal portion 54 which is attached to a fourth horizontal portion 56 through a second bent portion 58. A fourth vertical portion 60 is attached to fourth horizontal portion 56 at a right angle and is conductively attached to sheet member 26 at its free end. The free end of vertical member 52 is free and unattached to conductive sheet 26.

Driven element 34 and parasitic element 36 are disposed substantially parallel to one another above conductive sheet 26 separated by a distance designated L8 in FIG. 3. This distance as well as other critical distances of the antenna structure are designated as L8 through L18 in FIG. 3. For an antenna operable in the 800 to 900 Mhz frequency band, the dimensions L7 through L18 are tabulated in Table 1. These dimensions are, of course presented only by way of example and are not to be limiting. Those skilled in the art will recognize that these dimensions may be empirically or otherwise adjusted to obtain modified operational parameters.

TABLE 1

| | |
|---|---|
| L7 | 4.00 INCHES |
| L8 | 0.70 INCHES |
| L9 | 0.60 INCHES |
| L10 | 0.50 INCHES |
| L11 | 0.65 INCHES |
| L12 | 0.60 INCHES |
| L13 | 0.95 INCHES |
| L14 | 1.15 INCHES |
| L15 | 2.40 INCHES |
| L16 | 1.00 INCHES |
| L17 | 0.95 INCHES |
| L18 | 2.15 INCHES |

The bent portions of both the driven radiating element and the parasitic radiating element are utilized to bring the overall electrical length of the radiating elements up to approximately one quarter of a wavelength. These bent portions may or may not be necessary depending upon the amount of volume in which the antenna is to be placed.

In order to feed radio frequency energy to and from the present antenna structure, a mechanism may be provided to couple energy into and out of battery enclosure 24. Those skilled in the art will recognize various ways to accomplish this. A separate antenna terminal may be provided or other mechanisms may be devised.

In the preferred embodiment electrical battery 30 has its positive electrode connected to a positive terminal 62 and has its negative electrode connected to a negative terminal 64. The negative terminal may serve as a transceiver ground point and is attached to vertical member 32 by strap 65. Since it is desirable to have no more interconnection terminals on the battery enclosure 24 than necessary, radio frequency energy may be coupled through a transmission line 40 to positive terminal 62. The direct current component at terminal 62 may then be separated from the RF component in the transceiver. This may be accomplished by feeding the dc battery current through an inductor to the transceiver's fuse and on to the transceiver. If properly chosen, this inductor will prevent unacceptable levels of RF energy from interfering with the transceiver's DC bias networks. The RF signal may be delivered to or extracted from the antenna between the inductor and terminal 62. Those skilled in the art may recognized other ways to accomplish this.

While such mechanisms may be necessary for providing RF energy to the present antenna in a battery pack arrangement, it will be clear to those skilled in the art that such is not the case if the antenna is placed within the transceiver housing. In this case, the feed point 38 may be directly coupled to the transceiver via coaxial cable or other convenient mechanism.

If enclosed in the transceiver housing, there may be a slight improvement in performance by locating the antenna structure in the uppermost portion of the transceiver housing. Since this area is normally used to carry controls such as the channel selector and volume controls, a rearrangement of the configuration of the transceiver may be in order. The controls may be placed on the front of the transceiver, for example, or provisions may be made to ensure that the controls are configured so as not to interfere with the antenna's operation or vice versa.

The theory of the operation of the antenna structure is as follows. A transmission line, which in the preferred embodiment is a 50 ohm coaxial transmission line, feeds RF energy directly to the driven radiating element at feed point 38. As stated earlier, driven radiating element 34 is approximately one quarter of a wavelength in overall electrical length. The performance of this quarter wavelength radiating element alone is normally acceptable only over a very narrow range of frequencies. This is clearly too narrow in bandwidth for use over the wide bandwidths necessary with two-way portable transceivers where bandwidths of 10% or more of the center frequency may be required.

Table 2 shows the matching characteristics of the driven radiating element and counterpoise in the absence of the parasitic radiating element. It is clear that in the absence of the parasitic radiating element the driven radiating element is very poorly matched to the standard 50 ohm impedance of the typical power amplifier. Reflection coefficients less than 0.32 have been found acceptable for use with two-way portable transceivers and this criterion appears to never be met with the driven radiating element alone without a matching network.

TABLE 2

| Frequency (MHz) | Reflection Coefficient (Magnitude) | (Angle degrees) |
|---|---|---|
| 790 | 0.75 | −168 |
| 800 | 0.74 | −174 |
| 810 | 0.72 | 178 |
| 820 | 0.70 | 168 |
| 830 | 0.68 | 158 |
| 840 | 0.68 | 146 |
| 850 | 0.70 | 134 |
| 860 | 0.73 | 124 |
| 870 | 0.76 | 116 |
| 880 | 0.81 | 111 |
| 890 | 0.84 | 107 |
| 900 | 0.87 | 105 |

Table 3 shows the resultant reflection coefficient when the parasitic radiating element and the counterpoise structure are added to the driven radiating element. This resultant structure as shown in FIG. 3 performs well over a bandwidth approaching 100 MHz without the use of matching networks to properly match to the standard 50 ohm power amplifier. This results in a cost effective antenna arrangement usable over a number of band splits.

TABLE 3

| Frequency (MHz) | Reflection Coefficient (Magnetude) | (Angle Degrees) |
|---|---|---|
| 780 | 0.38 | 50 |
| 790 | 0.29 | 17 |
| 800 | 0.27 | −14 |
| 810 | 0.29 | −37 |
| 820 | 0.29 | −57 |
| 830 | 0.26 | −75 |
| 840 | 0.22 | −94 |
| 850 | 0.18 | −119 |
| 860 | 0.17 | −166 |
| 870 | 0.23 | 158 |
| 880 | 0.33 | 141 |
| 890 | 0.44 | 131 |
| 900 | 0.54 | 126 |

In the preferred embodiments the present antenna arrangement is implemented either inside the housing of the transceiver or inside the battery enclosure. These enclosures provide protection for the antenna but also restrict the length that the antenna's radiating elements may occupy. In the preferred embodiment, the battery enclosure and the transceiver housing are approximately 2.75 inches long by 0.8 inches deep by 1.5 inches wide resulting in the use of U-shaped bends 48 and 58 to increase the overall lengths of both the driven radiating element 34 and the parasitic radiating element 36. Depending upon the specific application, these bends may or may not be needed.

In the 800 to 900 MHz frequency band, a separation of approximately 1/20th of a wavelength has been found satisfactory for the distance between elements 34 and 36. This should not be limiting however. The proper separation in other frequency bands should be determined by trial and error but a reasonable starting place might be 1/20th of a wavelength and it is expected that the proper spacing will usually lie close to 1/20th of a wavelength. At this close spacing, the current induced in the parasitic radiating element by excitation of the driven radiating element is substantial. The separation of the two elements is important to the proper operation of the antenna structure. Spacings which are too close or too far away may prove unsatisfactory.

In addition to the currents induced in the parasitic radiating element, substantial currents are induced in the counterpoise structure. This counterpoise structure may take many forms such as vertical conductive members 32 or metalized enclosures, but a proper counterpoise should be provided to obtain efficient radiation.

In the present antenna arrangement, the driven radiating element, the parasitic radiating element and the counterpoise all interact to create a resulting distributed reactance which provides wide band tuning of the antenna structure over the frequency band of interest. For a 10 dB return loss (Reflection coefficient of approximately 0.32) the present antenna is usable over approximately 100 MHz in the frequency band of interest.

Figure 4:
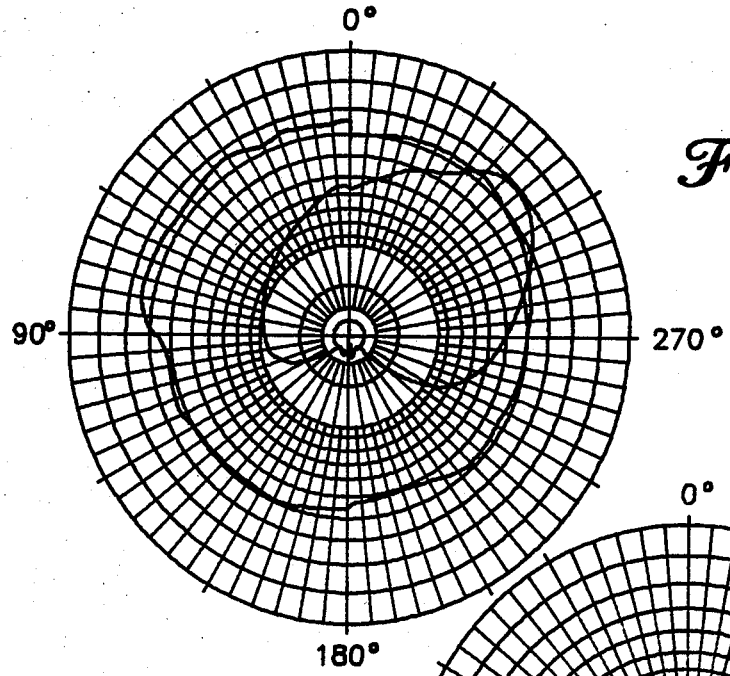
FIG. 4 shows a vertical radiation pattern of the present invention compared with that of a conventional sleeve dipole antenna with the transceiver hand held in front of the face.
Figure 6:
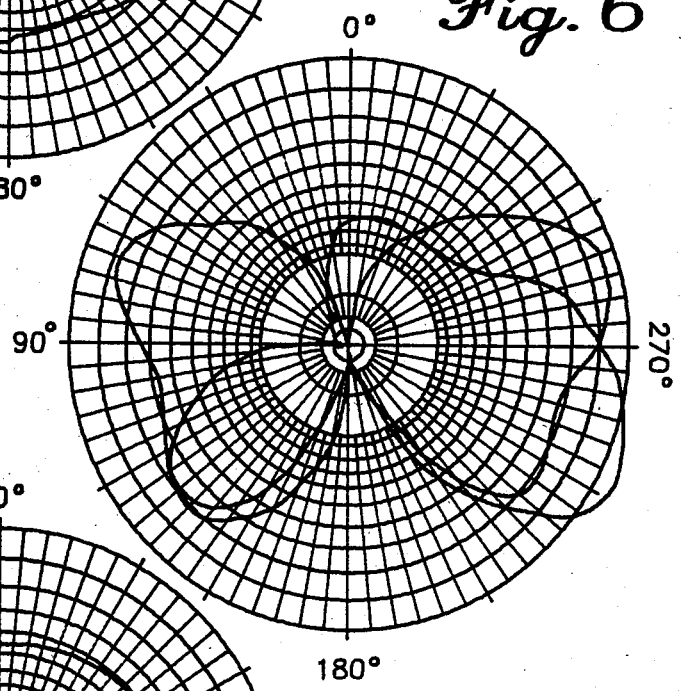
FIG. 6 shows a horizontal radiation pattern of the present invention compared with that of a conventional sleeve dipole antenna in free space.
Figure 5:
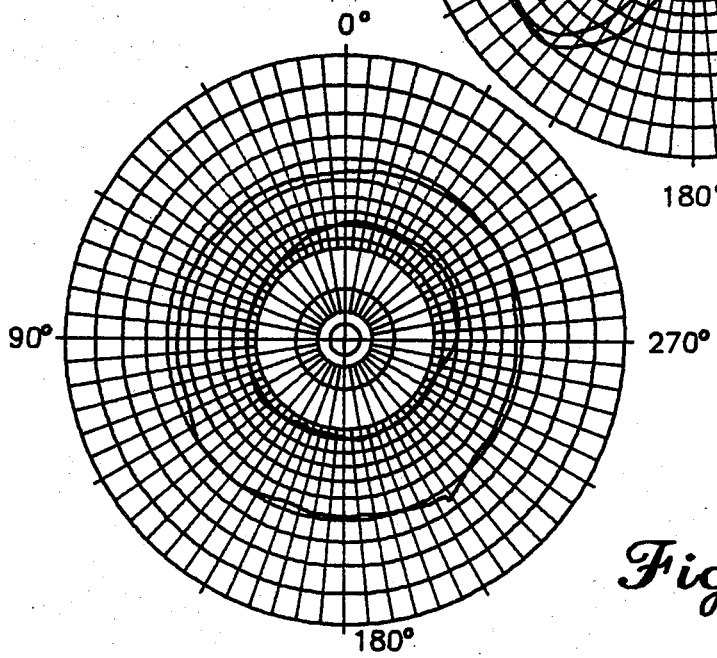
FIG. 5 shows a vertical radiation pattern of the present invention compared with that of a conventional sleeve dipole antenna in free space.

Turning now to FIGS. 4, 5 and 6 various radiation patterns are shown for the present antenna structure compared with radiation patterns for a conventional sleeve dipole antenna. Each curve is on a linear scale so that the overall performance of the present antenna structure is only approximately 3 dB lower than the conventional sleeve dipole while resulting in a height reduction of the transceiver of approximately 6.7 inches.

FIG. 4 is a vertical radiation patterns with the transceiver hand held at the face to simulate the normal transmitting posture. The sleeve dipole characteristics are shown by curve 80 while the present antenna's characteristics are shown by curve 82. In some areas, the present antenna can even be seen to outperform the high gain sleeve dipole.

FIG. 5 is a vertical radiation pattern for both antenna structures in free space. Curve 84 represents the sleeve dipole characteristics while curve 86 represents the present antenna's characteristics. In this figure, free space performance of the present antenna is seen to be only a few dB down from the high gain sleeve dipole and having a similar shape. Of course, the present invention would rarely be operated in free space so that FIG. 5 is only usefull for theoretical comparisons.

FIG. 6 shows a comparison of the horizontal radiation patterns of the two antennas. Curve 88 represents the sleeve dipole characteristics while curve 90 represents the characteristics of the present invention. This is once again a free space pattern showing the two antenna configurations to be quite comparable.

The present low profile ntenna structure is also especially advantageous when the transceiver is in the receive mode and carried on the body of the user (for example clipped to the belt). In this posture, the conventional sleeve dipole is severely detuned by the close proximity of the user's body. The present invention performs well in this environment allowing good receiver sensitivity.

Thus it is apparent that in accordance with the present invention an apparatus that fully satisfies the objectives, aims and advantages is set forth above. While the invention has been described in conjunction with a specific embodiment, it is evident that many alternatives, modifications and variations will become apparent to those skilled in the art in light of the foregoing description. Accordingly, it is intended that the present invention embrace all such alternatives, modifications and variations as fall within the spirit and broad scope of the appended claims.

What is claimed is:

1. A low profile antenna structure suitable for use over a range of frequencies about a center frequency and for use in conjunction with a portable two-way transceiver, said antenna structure comprising:

a counterpoise including a substantially planar conductive top sheet having top and bottom opposed major surfaces and having first and second opposed ends;

a first conductive side sheet having opposed ends, one end of which is coupled to the first end of said top sheet, said first side sheet being oriented substantially perpendicular to said top sheet and extending away from the bottom surface of said top sheet;

a second conductive side sheet having opposed ends, one end of which is coupled to the second end of said top sheet, said second side sheet being oriented substantially perpendicular to said first sheet and extending away from the bottom surface of said top sheet;

said top sheet and said first and second side sheets being oriented in a substantially U-shaped configuration with respect to each other;

a driven radiating element having a driven end and a free end, said driven radiating element being situated adjacent and atop the top surface of said top sheet, said driven radiating element having a total electrical length of approximately one quarter of a wavelength at said center frequency;

a feed point coupled to said driven end for coupling radio frequency energy to said driven radiating element; and a parasitic radiating element having first and second ends and being situated adjacent and atop the top surface of said top sheet, said parasitic radiating element having a total electrical length of approximately one quarter of a wavelength at said center frequency, said parasitic radiating element being substantially parallel to said driven radiating element and separated therefrom by a distance of approximately 1/20th of a wavelength so that the driven end of said driven element and the first end of said parasitic element, and the free end of said driven element and the second end of said parasitic element, respectively, are closest together, the second end of said parasitic element being coupled to said conductive sheet.

2. The antenna structure of claim 1, wherein said driven radiating element includes first and second right angle bends, said first situated near said driven end, said second bend situated near said free end, wherein said driven and free ends point toward said conductive top sheet.

3. The antenna structure of claim 1, wherein said driven radiating element includes a substantially U-shaped bend situated near the center of the driven radiating element.

4. The antenna structure of claim 1, wherein said parasitic radiating element includes first and second right angle bends, said first bend situated near the first end of said parasitic radiating element, said second bend situated near the second end of said parasitic raditing element, wherein said first and second ends point toward said conductive top sheet.

5. The antenna structure of claim 1, wherein said parasitic radiating element includes a substantially U-shaped bend situated near the center of the parasitic radiating element.

6. The antenna structure of claim 1, wherein said counterpoise includes a metalized enclosure.

* * * * *